United States Patent [19]

Hennig et al.

[11] 4,008,017

[45] Feb. 15, 1977

[54] SEAL ARRANGEMENT FOR ROTARY ENGINES

[75] Inventors: Karl-Friedrich Hennig, Schloss Ricklingen; Wolfgang Kalthenthaler, Wennigsen; Werner Heger, Hover; Fritz Isernhagen, Letter; Manfred Kramer, Barsinghausen; Wilhelm Pape, Wunstorf, all of Germany

[73] Assignee: WABCO Westinghouse GmbH, Hannover, Germany

[22] Filed: Oct. 20, 1975

[21] Appl. No.: 623,766

[30] Foreign Application Priority Data

Oct. 31, 1974 Germany ..... 2451669

[52] U.S. Cl. ..... 418/129; 418/123; 418/125

[51] Int. Cl.[2] ..... F04C 27/00

[58] Field of Search ..... 418/113, 122, 123, 124, 418/125, 129, 249, 251, 267, 268

[56] References Cited

UNITED STATES PATENTS

| | | | |
|---|---|---|---|
| 674,258 | 5/1901 | Croston | 418/267 |
| 825,374 | 7/1906 | Black | 418/267 X |
| 3,182,641 | 5/1965 | Lamm | 418/124 X |
| 3,207,426 | 9/1965 | Gassman | 418/124 X |
| 3,764,239 | 10/1973 | Huf | 418/125 X |
| 3,881,848 | 5/1975 | Huf | 418/123 |

FOREIGN PATENTS OR APPLICATIONS

| | | | |
|---|---|---|---|
| 8,123 | 11/1910 | United Kingdom | 418/268 |

*Primary Examiner*—C. J. Husar
*Assistant Examiner*—Leonard Smith
*Attorney, Agent, or Firm*—R. S. Visk; R. W. McIntire, Jr.

[57] ABSTRACT

Seals for providing sealing contact between the rotary piston and the apexes of the casing of a rotary type combustion engine, compressor, or pump for sealing the several pressure chambers, one from the other or others, during operation. The seals are disposed in radially formed slots at each apex of the housing and are so constructed to permit pressure in the chamber being pressured to be communicated to the rear side of the seal, or the side opposite that which makes sealing contact with the rotary piston, so that such pressure acting on the rear side may assist the spring normally acting against the same side in forcing the seal against the rotary piston with greater pressure and thereby provide a better sealing effect.

4 Claims, 8 Drawing Figures

SEAL ARRANGEMENT FOR ROTARY ENGINES

BACKGROUND OF THE INVENTION

One of the major problems encountered with rotary engines is in providing effective sealing between the rotary piston and the housing for insuring efficient pressure isolation of the several pressure chambers relative to each other during operation of the engine. The sealing elements used for this purpose are usually in the form of elongated strips radially slidably disposed in receiving slots formed either in apexes of the housing or the apexes of the rotary piston, depending upon the design of the engine, said strips having a sealing edge making sealing contact with either the peripheral surface of the piston or the inner contour curved surface of the housing, as the case may be, the other edge of said sealing strip usually having acting thereagainst some form of spring means for urging the sealing edge of the sealing strip into sealing contact with the surface it rides against. Since the pressure in the chamber being pressurized acts against the sealing edge of the sealing strip and, therefore, in opposing relation to the force exerted by the spring means, the sealing effect, as well as the efficiency of the engine, is undesirably reduced.

One of the presently known solutions to the problem above set forth provides means for communicating pressure from the chamber being pressurized to a space behind the sealing strip, which thus not only compensates for the pressure acting on the sealing edge, but also assists the spring means in pressing the sealing strip into better sealing engagement with the surface contacted. In order to communicate pressure to the space behind the sealing strip, various bore and valve arrangements have been provided either in the housing or piston, but these arrangements have been found to be too costly or do not necessarily provide trouble-free operation.

SUMMARY OF THE INVENTION

The object of the present invention, therefore, is to provide a seal arrangement for rotary engines or compressors, whereby effective sealing relation is attained between the rotary piston and the housing and, therefore, between the several pressure chambers of the engine.

Briefly, the invention for use in rotary engines or compressors comprises sealing elements in the usual strip form slidably carried in receiving slots radially formed in the apexes of either the rotary piston or the housing, depending upon the design of the engine or compressor, said strips having formed therein passage means whereby pressure from the specific chamber being pressurized at any given time may be communicated to a space in the slot behind the sealing strip disposed in said slot, so that such pressure may act in pressing the sealing edge of the sealing strip or element into better sealing engagement with the surface on which it rides.

DESCRIPTION AND OPERATION

Figure 1:
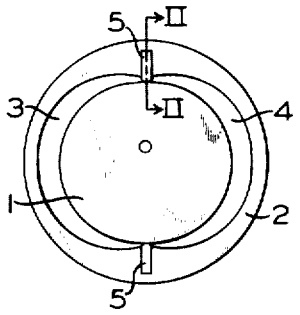
FIG. 1 is an elevational view, in section, of a simple dial chamber rotary type engine.

FIG. 1 illustrates a simple trochoid type rotary engine with one side removed so as to show disposed therein a rotary piston 1 operable in conventional manner in a housing 2 for alternately generating and reducing pressure in oppositely disposed operating pressure chambers 3 and 4. Similar seals 5 are arranged at diametrally opposite apexes of housing 2 for providing an air tight relationship between chambers 3 and 4, the degree of such air tightness being determined by the efficiency of said seals.

Figure 2:
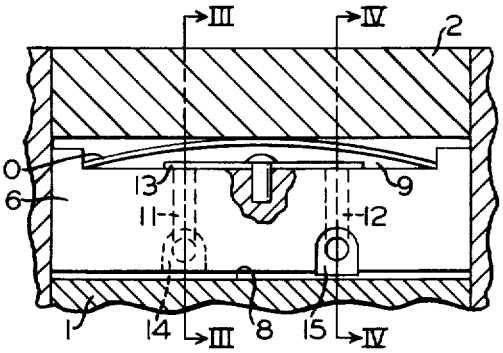
FIG. 2 is a fragmental sectional view taken along line II—II of FIG. 1 and on a larger scale, as viewed in the direction indicated by the arrows.
Figure 3:
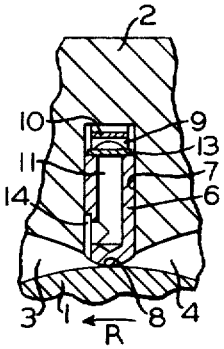
FIG. 3 is a fragmental sectional view taken along line III—III of FIG. 2 and on the same scale, as viewed in the direction indicated by the arrows.
Figure 4:
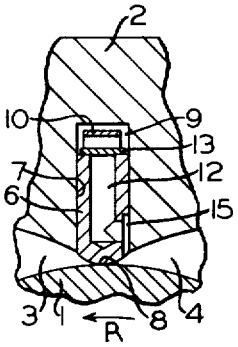
FIG. 4 is a fragmental sectional view taken along line IV—IV of FIG. 2 and on the same scale, as viewed in the direction indicated by the arrows.

As shown in FIGS. 2, 3, and 4, seal 5 comprises a conventionally shaped seal strip or element 6 radially slidably carried in a radially disposed slot 7 formed in housing 2. The lower side or edge, as viewed in FIGS. 2, 3, and 4, is adapted for making sealing contact with the adjacent peripheral surface of rotary piston 1, as indicated at 8 in FIGS. 2, 3, and 4. The upper or opposite side of seal strip 6 cooperates with housing 2 to form a spring chamber 9 in which a leaf type spring 10 is disposed for exerting a downwardly directed force on said seal strip for urging the seal strip into sealing contact with rotary piston 1.

According to the invention, seal strip 6 is provided with spaced apart bores 11 and 12 opening at the upper ends thereof to chamber 9. A flexible plate type valve member 13 is secured at its mid-point to the upper side of seal strip 6 with the opposite ends of said valve plate extending over and normally covering the upper respective openings of bores 11 and 12. Valve member 13 is of such flexibility that any pressure buildup thereunder in either bore 11 or 12 will cause the plate to be lifted off the upper opening of the bore and allow such pressure to flow into chamber 9 to act on the upper side of seal strip 6 and, therefore, exert additional downward force on said seal strip against rotary piston 1. Each end of plate valve 13, therefore, acts as a one-way check valve in permitting flow of pressure in one direction only, that is, into spring chamber 9, but preventing back flow therefrom.

Bores 11 and 12 are open at their lower ends to chambers 3 and 4 via spaced apart recesses 14 and 15 formed on opposite lateral faces of seal strip 6 and in communication with said chambers, respectively, as may be seen in FIGS. 3 and 4.

Thus, in operation, assuming rotary piston 1 to be rotating in the direction indicated by arrow R and chamber 3 under compression, pressure flows through recess 14 and bore 11, past the adjacent end of valve plate 13 into chamber 9 to act on the top side of seal strip 6, and thereby exert a downwardly directed force, which along with that exerted by spring 10, causes the lower sealing edge of said seal strip to make effective sealing contact at 8 with said rotary piston. Since there is no pressure in bore 12 communicating with depressurized chamber 4, pressure in chamber 9 acting on the end of valve plate 13 covering the upper end of said bore, is effective for keeping said valve plate closed thereover.

As piston 1 continues to rotate the pressure situation in chambers 3 and 4 reverses, that is, chamber 3 is depressurized while chamber 4 is pressurized, in which case valve plate 13 acts to close off communication of bore 11 with chamber 9 while pressure from chamber 4 flows via recess 15 and bore 12, past said valve plate into chamber 9 with results similar to those discussed above in connection with pressurization of chamber 3.

Figure 5:
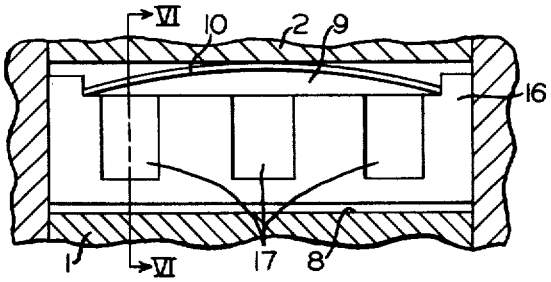
FIG. 5 is a fragmental sectional view, similar to FIG. 2 and on the same scale, showing a modified seal structure.
Figure 6:
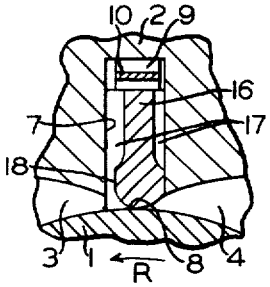
FIG. 6 is a fragmental sectional view taken along line VI—VI of FIG. 5 and on the same scale, as viewed in the direction indicated by the arrows.

The embodiment of the invention shown in FIGS. 5 and 6 comprises a seal strip 16 disposed in slot 7 of casing 2 similarly to seal strip 6 shown in FIGS. 2, 3, and 4. Seal strip 16 has formed on the opposite lateral faces thereof a plurality of spaced apart recessed passageways 17 which all open to the top side of said seal strip and, therefore into chamber 9, but terminate short of opening into the respective chambers 3 and 4.

Since seal strip 16 must by construction be free to move radially in slot 7, a certain amount of tolerance must be provided between the lateral faces of said seal strip and the respective adjacent sides of slot 7. This tolerance is exageratedly indicated diagrammatically as a gap 18 in FIG. 6. As compression occurs in chamber 3, pressure penetrates through gap 18 on the side of seal strip 16 adjacent said chamber 3 into the connecting passageways 17, thence into chamber 9 to act on the top side of said seal strip in similar fashion as described in connection with the embodiment shown in FIGS. 2, 3, and 4. When compression shifts from chamber 3 to chamber 4, pressure thus generated would penetrate through a gap (not shown) between the right sides (as viewed in FIG. 6) of seal strip 16 and slot 7 into the connecting passageways 17 on said right side, thence into chamber 9, to provide pressure assisting spring 10 in urging said seal strip into sealing contact at 8.

Figure 7:
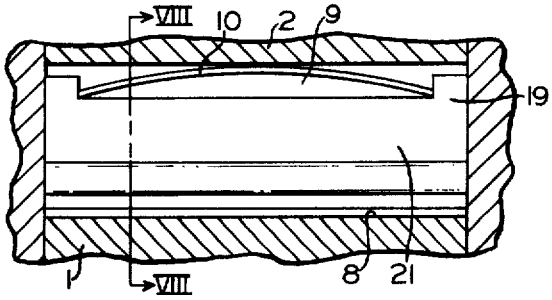
FIG. 7 is a fragmental sectional view, similar to FIGS. 2 and 5 and on the same scale, showing a modified seal structure.
Figure 8:
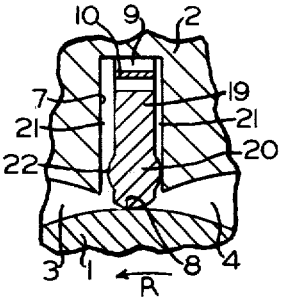
FIG. 8 is a fragmental sectional view taken along line VIII—VIII of FIG. 7 and on the same scale, as viewed in the direction indicated by the arrows.

The embodiment of the invention shown in FIGS. 7 and 8 also comprises a seal strip 19 axially slidably disposed in slot 7 of casing 2. In this instance, the cross-sectional shape of seal strip 19 adjacent the sealing edge thereof is generally circular in shape to form a circular portion 20 extending the length of the seal strip. The opposite sides of seal strip 19 are cut away to reduce the thickness of above circular portion 20 to less than the diameter of said circular portion, and thus, in effect, form longitudinal recesses 21 thereon extending the entire length of said seal strip, said recesses communicating with chamber 9. The tolerance between circular portion 20 and the sides of slot 7 is again utilized in permitting pressure from chamber 3, for example, when being pressurized by piston 1, to penetrate through the gap provided thereby and again exaggeratedly indicated diagrammatically as a gap 22 in FIG. 8, into recess 21 and chamber 9, it being understood that the gap would occur on the right side of circular portion 20 when chamber 4 is under compression. The results are similar to those discussed in connection with seal strip 16 shown in FIGS. 5 and 6.

Having now described the invention what we claim as new and desire to secure by Letters Patent, is:

1. In a rotary type engine including a housing, a rotary piston operably disposed in a piston chamber in the housing and cooperative therewith for forming a plurality of operating pressure chambers each alternately pressurized and depressurized in sequential order by operation of the piston, and respective seals for sealingly isolating the several chambers, particularly the chamber being pressurized, from each other and the others, respectively, during operation, each of said seals comprising:

a. a seal strip slidably disposed in a slot cooperatively located relative to the housing and the piston, said slot having a closed end radially inwardly thereof and an outer open end opening to the piston chamber, one edge of said strip projecting from said open end of said slot to form a sealing relationship between the housing and the piston, and the opposite edge of said strip cooperating with said closed end of said slot to form a spring chamber adjacent thereto, b. said seal strip having formed therein a plurality of bores each having one end thereof opening to said spring chamber and the opposite ends thereof opening to the piston chamber, one half to one side of said one edge of the seal strip and the other half to the other side of said one edge of the seal strip;

c. one-way check valves provided at the ends of each of said bores opening to said spring chamber; and d. spring means disposed in said spring chamber for exerting a spring force on and urging said seal strip radially outwardly from the slot to provide said sealing relationship.

2. The combination as set forth in claim 1, wherein said plurality of bores comprises a pair.

3. The combination as set forth in claim 1, wherein said slot is formed in the housing.

4. The combination as set forth in claim 1, wherein said one-way check valves comprise a flexible plate member secured at its mid-point to the seal strip with each end thereof extending over and normally covering the respective ends of said bores opening to said spring chamber, each end of said plate member being yieldable to pressure prevailing in the respective bore from the operating chamber being pressurized.

* * * * *